United States Patent [19]

Anderson et al.

[11] 4,176,827

[45] Dec. 4, 1979

[54] WINCH DRUM MOUNTED DIRECTLY ON A WORM GEAR DRIVE UNIT

[75] Inventors: Clay H. Anderson; Gerard St. Jean, both of North Vancouver, Canada

[73] Assignee: C. H. Anderson and Associates Ltd., North Vancouver, Canada

[21] Appl. No.: 792,870

[22] Filed: May 2, 1977

[51] Int. Cl.[2] ..... B66D 1/00

[52] U.S. Cl. ..... 254/186 R; 254/150 R

[58] Field of Search ..... 254/184, 150 R, 186 R, 254/170, 171; 74/467, 417

[56] References Cited

U.S. PATENT DOCUMENTS

| | | | |
|---|---|---|---|
| 897,560 | 9/1908 | Stosick | 254/170 |
| 1,245,623 | 11/1917 | Schnick | 254/170 |
| 1,402,469 | 1/1922 | Baltes | 254/170 |
| 3,658,299 | 4/1972 | Sprague | 254/150 R |
| 3,788,607 | 1/1974 | Crooks | 254/186 R |

FOREIGN PATENT DOCUMENTS

| | | | |
|---|---|---|---|
| 281873 | 2/1915 | Fed. Rep. of Germany | 254/170 |

*Primary Examiner*—Robert J. Spar
*Assistant Examiner*—Kenneth Noland
*Attorney, Agent, or Firm*—Stanley E. Johnson; Richard J. Hicks

[57] ABSTRACT

A winch mounted directly on the gear of a worm gear drive unit and cantilevered outwardly therefrom through an opening in a housing in which the gear is journalled for rotation by a hub having a pair of spaced apart circular bearing lands journalled in apertures in a pair of spaced apart walls in the housing. The worm is journalled for rotation in the housing and meshes with the gear in drive relation. The worm is driven by a motor mounted on the housing.

9 Claims, 4 Drawing Figures

WINCH DRUM MOUNTED DIRECTLY ON A WORM GEAR DRIVE UNIT

RELATED APPLICATIONS

U.S. application Ser. No. 625,460 filed Oct. 24, 1975 entitled "Universal Coupling" now U.S. Pat. No. 4,022,410.

FIELD OF INVENTION

This invention relates to a winch for winding in and paying out a cable.

BACKGROUND OF INVENTION

In the aforementioned application Ser. No. 625,460 there is disclosed a universal coupling of particular design for mounting a work head on the boom of a mobile machine and to a machine incorporating the same. The universal coupling consists of two identical worm and gear drive units connected to one another permitting angular adjustment of the work head about two mutually perpendicular axes. A machine having the work head mounted thereon by the universal coupling is intended for drilling holes in rock but may be used for other applications, such as mounting a felling head on the free end of an extendible and retractable boom in a tree felling machine.

A continuation of the aforementioned application filed on is directed to the particular design of the worm drive unit.

The present application is directed to a winch comprising the combination of a winch drum and worm gear drive unit.

In presently known winches for heaving loads, such as in logging operations, the winch drums are normally journalled for rotation on a suitable base and drivingly connected through a gear train to a power source. A worm gear drive unit disclosed in the above applications has been found to be particularly suitable for winches as its construction allows mounting the winch drum on the gear of the drive overcoming the need for a separate shaft and journals for the winch drum.

SUMMARY OF INVENTION

Accordingly, there is provided in accordance with the present invention a winch comprising (a) a rigid housing having first and second spaced apart side walls; (b) a hub having a pair of spaced apart circular bearing lands on the outer surface thereof journalled for rotation respectively on said first and second side walls; (c) teeth projecting outwardly from said hub at a position between said bearing lands providing a gear; (d) a worm journalled for rotation on said housing and meshing with said gear in drive relation; (e) bearing faces extending outwardly from the hub respectively on opposite sides of the gear and engageable with the walls of the housing limiting axial displacement of the hub relative thereto; (f) an opening in one of said side walls exposing said hub therethrough; and (g) a winch drum directly and rigidly connected to said hub through said opening and projecting outwardly therefrom.

BRIEF DESCRIPTION OF DRAWINGS

The invention is illustrated by way of example with reference to the accompanying drawings wherein.

DETAILED DESCRIPTION

Figure 2:
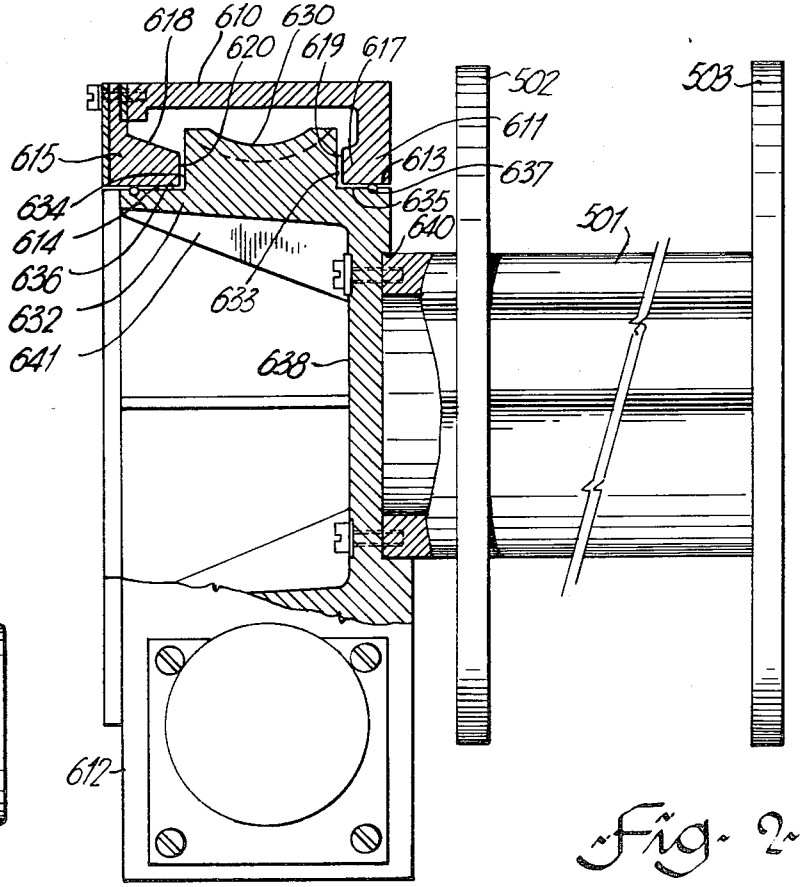
FIG. 2 is a side elevational view, in partial section, of the power driven winch illustrated in FIG. 1.
Figure 1:
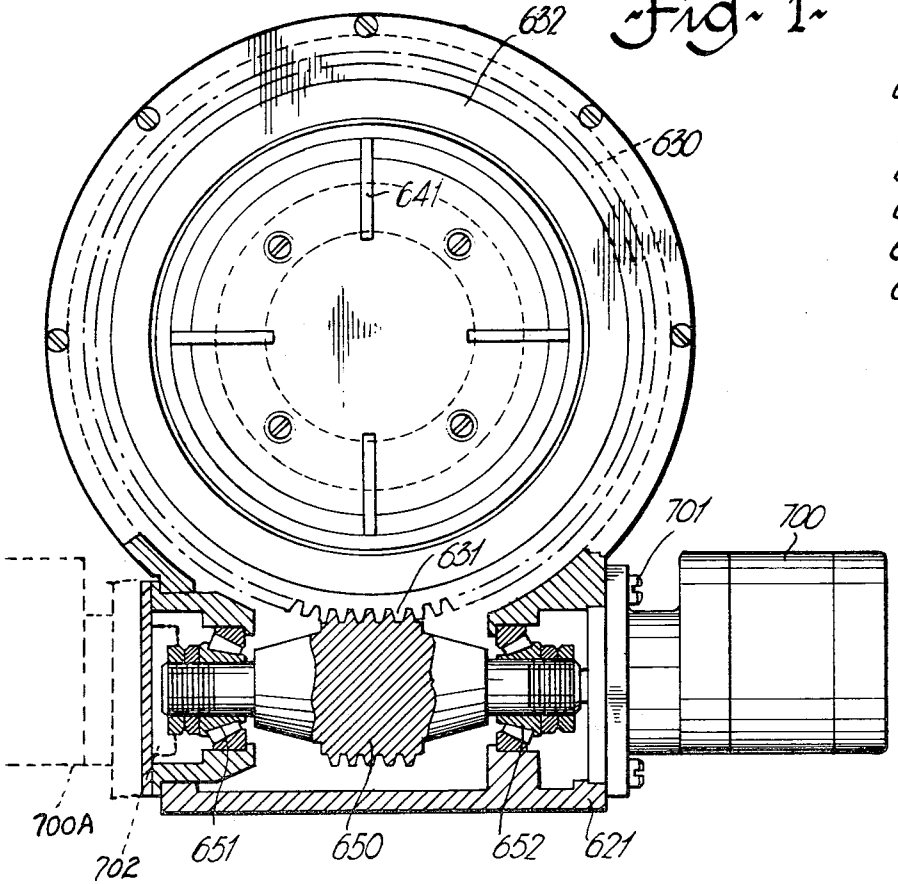
FIG. 1 is an end elevational view, in partial section, of a power driven winch provided in accordance with the invention.

Referring now to the drawings, there is illustrated in FIGS. 1 and 2 a power driven winch consisting of a spool type winch drum 500 coupled directly to a worm and gear drive 600 which in turn is driven by an electric or hydraulic motor 700. The spool drum 500 has a tubular hub 501 and at least two flanges 502 and 503 secured thereto in spaced apart relation relative to one another.

The worm and gear drive unit comprises a housing 610 having a gear 630 journalled therein and meshing with a worm 650. The housing 610 is a rigid unit having a pair of spaced apart side walls 611 and 612 with respective openings 613 and 614. Opening 614 is located in a plate 615 attached to the side wall 612 by a plurality of threaded studs 616 and defines a portion of the side wall. The holes 613 and 614 are circular and circumscribed by respective ribs 617 and 618 directed inwardly toward one another and having respective bearing faces 619 and 620 in face-to-face spaced apart relation. The housing 610 has a lower base portion 621 in which the worm 650 is journalled for rotation and on which the motor 700 is mounted.

The gear 630 consists of a plurality of teeth 631 projecting outwardly from a hub 632 and has oppositely directed respective side faces 633 and 634 engageable with respective bearing faces 619 and 620 to prevent axial displacement of the hub and gear relative to the housing. The outer surface of the hub has respective spaced apart bearing lands 635 and 636 located in the side wall holes 613 and 614 journalling the gear and hub for rotation. The bearing lands are provided with O-ring seals 637 preventing lubricant from escaping from the interior of the housing. The hub 632 has a central web 638 located at one end thereof substantially in alignment with the end wall 611 and to which the hub 501 of the spool drum is mounted by studs 639 or by welding, if desired. The web 638 may, if desired, by provided with a recess 640 for the purpose of locating the spool hub concentric with respect to the rotational axis of the hub 632. The web 638 and 632 are reinforced by a plurality of gussets 641 on the inner surface of the hub.

Figure 4:
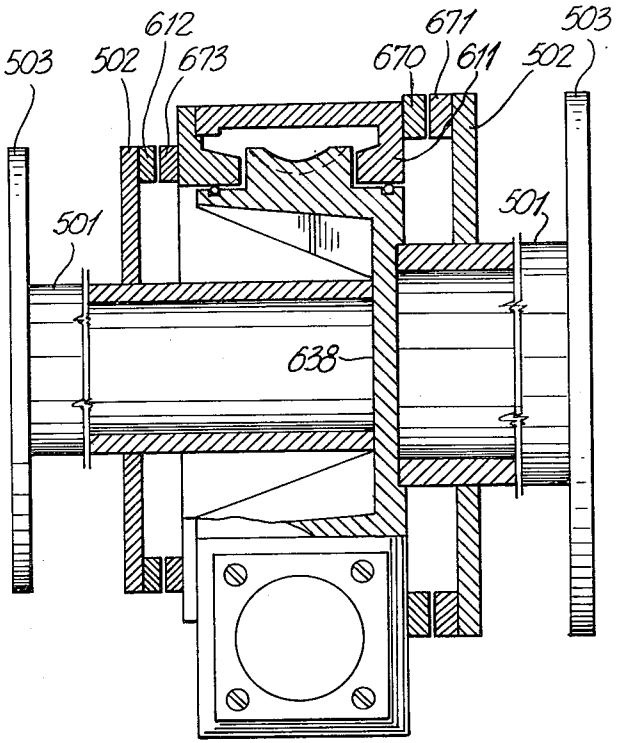
FIGS. 3 and 4 are views, similar to FIG. 2, illustrating respectively two different modifications.

The spool drum 500 is effectively cantilevered outwardly from the gear and hub unit and such arrangement is permitted by having relatively large bearing lands 635 and 636 spaced apart from one another. The construction is simple and yet provides a robust unit for withstanding heavy load forces applied when winding a cable onto the spool drum. Additional bearing surfaces may be provided, if desired, in a manner as illustrated in FIG. 4 and which consist of annular rings 670 and 671 secured respectively to the housing side wall 611 and flange 502. The annular rings are arranged concentric with the axis of rotation of the gear and have bearing faces disposed in face-to-face relation.

The worm 650 is mounted on a shaft journalled for rotation in the housing by respective bearings 651 and 652. The shaft is coupled directly in drive relation to the drive shaft of motor 700. The motor is detachably mounted on the housing by a plurality of threaded studs 701.

Figure 3:
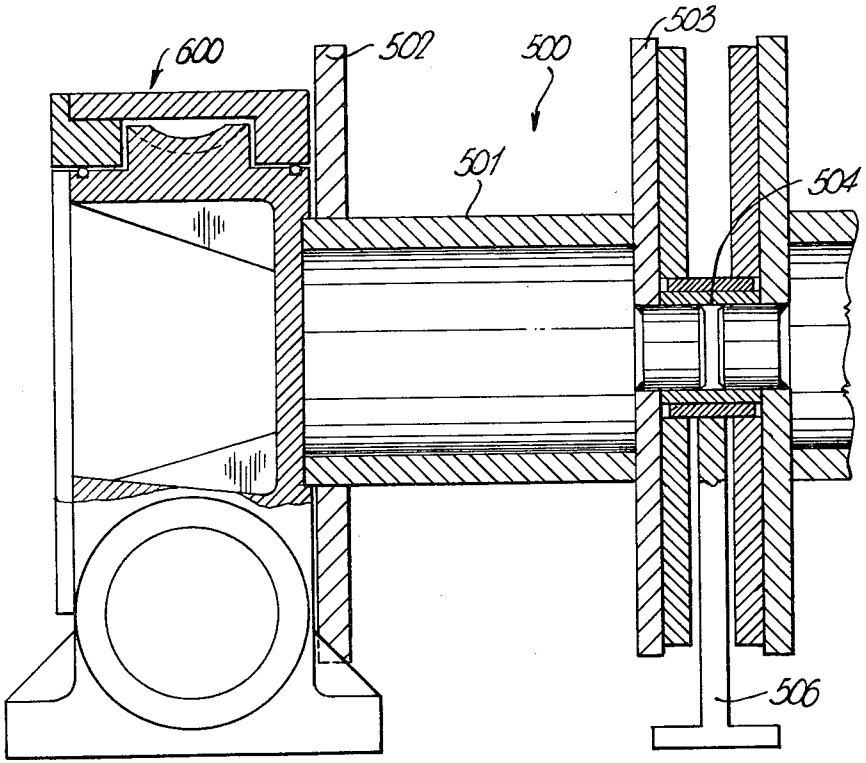

If it is desired to have two or more driven winch drums for a cable system, units of the foregoing type may be arranged as shown in FIGS. 3 and 4 or combinations thereof. Referring to FIG. 3, there is illustrated two worm and gear drive winches of the type illustrated in FIGS. 1 and 2 but wherein the free outer end of the respective spool drums 500 are supported by a common bearing 504 mounted on a supporting structure 506. In FIG. 3 the worm gear drive on the right hand side has been omitted as it is the same as that shown on the left hand side. As for direction of rotation of the winch drums, motor 700 may be a unidirectional type or reversible. Further two motors may be drivingly connected respectively to opposite ends of the shaft on which worm 650 is mounted. The drive shaft of the motors may be connected to the worm shift either directly or through a clutch and also may be arranged to drive in unison or independent of one another. In FIG. 1 there is illustrated in dotted line a second motor 700A connected to the worm shaft by a clutch 702.

In FIG. 4 there is illustrated a still further alternative arrangement wherein two spool drums 500 are mounted on the web 638 of the hub and project outwardly therefrom in opposite directions. Additional support for the second spool drum may be provided, if desired, by additional annular bearing rings designated 672 and 673. If desired, two units as shown in FIG. 4 may be arranged in the same manner as shown in FIG. 3 providing a winch with four spool drums, two adjacent ones of which are supported also by a journal 504 and support 506.

We claim:

1. A winch comprising:

(a) a rigid housing having first and second spaced apart side walls, one of said side walls having a plate detachably secured thereto and providing a portion of said one of said side walls;

(b) a hub having a pair of spaced apart relatively large diameter circular bearing lands on the outer surface of said hub and journalled for rotation respectively on said first and second side walls, one of said bearing lands being journalled for rotation on said plate, said hub having a central web formed integrally to said hub and said web consisting of a flat face surface positioned in a plane transverse to the axis of rotation of the hub for mounting a winch drum;

(c) teeth formed integrally with the hub and projecting outwardly therefrom at a position between said bearing lands and said teeth providing a gear only slightly larger in diameter than said bearing lands;

(d) a worm gear journalled for rotation in said housing and meshing with said teeth in drive relation;

(e) bearing faces extending outwardly from the hub respectively on opposite sides of the teeth and engageable with the side walls of the housing limiting axial displacement of the hub;

(f) an opening in one of said side walls exposing said hub therethrough; and (g) said winch drum being detachably secured directly to the web of the hub and cantilevered therefrom, said winch drum being disposed exteriorly of the housing for winding a cable thereon.

2. A winch as defined in claim 1 wherein said bearing lands are disposed closely adjacent opposite side faces of said teeth and wherein said side faces provide the bearing faces extending outwardly from the hub.

3. A winch as defined in claim 1 wherein said web and one of the bearing lands are substantially in alignment with each other.

4. A winch as defined in claim 1 wherein said plate and the other wall of said side walls have annular flanges directed inwardly toward one another providing bearing surfaces engageable with respective ones of the outwardly directed bearing faces on the hub.

5. A winch as defined in claim 1 including a motor mounted on the housing and drivingly connected to said worm gear.

6. A winch as defined in claim 1 including additional bearing means supporting said winch drum.

7. A winch as defined in claim 1 wherein said winch drum has a flange disposed adjacent said one of said side walls and including bearing means respectively on said one of said side walls and flange and disposed in face-to-face relation providing additional bearing support for said winch drum.

8. A winch as defined in claim 1 and including another winch of the same construction as defined in claim 1 and thereby constituting a pair of winches, said pair of winches being disposed as a mirror image of one another and having the winch drums of each of the pair of winches closely adjacent one another in coaxial alignment and further supported by a supported bearing disposed between the winch drums.

9. A winch as defined in claim 1 including another winch drum secured to said web and located externally of said housing on a side thereof and being opposite to that of said first mentioned winch drum.

* * * * *